US008079874B2

(12) United States Patent
Lee et al.

(10) Patent No.: US 8,079,874 B2
(45) **Date of Patent: *Dec. 20, 2011**

(54) ELECTRICAL CONNECTOR WITH TERMINAL POSITIONING STRUCTURE

(75) Inventors: Kuo-Chi Lee, Taipei County (TW); Chin-Huang Lin, Taipei County (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 156 days.

This patent is subject to a terminal disclaimer.

(21) Appl. No.: 12/363,933

(22) Filed: Feb. 2, 2009

(65) Prior Publication Data

US 2010/0167594 A1 Jul. 1, 2010

(30) Foreign Application Priority Data

Dec. 26, 2008 (TW) ..... 97223332 U

(51) Int. Cl.
*H01R 13/648* (2006.01)

(52) U.S. Cl. ..... 439/607.32; 439/660

(58) Field of Classification Search ..... 439/660, 439/607.32, 875, 79
See application file for complete search history.

(56) References Cited

U.S. PATENT DOCUMENTS

| | | | | |
|---|---|---|---|---|
| 6,200,171 | B1 * | 3/2001 | Fusselman et al. | 439/736 |
| 7,578,700 | B2 * | 8/2009 | Xiong et al. | 439/607.01 |
| 7,625,234 | B1 * | 12/2009 | Lee et al. | 439/607.07 |
| 2004/0097128 | A1 * | 5/2004 | Wu | 439/567 |

* cited by examiner

*Primary Examiner* — Vanessa Girardi
(74) *Attorney, Agent, or Firm* — Rosenberg, Klein & Lee

(57) ABSTRACT

An electrical connector includes a positioning member; an insulated main body enclosing the positioning member from above and a plurality of terminals. Each terminal has a contact section embedded within a tongue plate of the insulated main body and an inclined section embedded partially within the positioning member via an insert-molding process. When the inclined section is further bent relative to the contact section, the uniform spacing and alignment among the terminals is maintained precisely due to the insert-molding process of the terminals in the insulated main body and the positioning member.

6 Claims, 5 Drawing Sheets

ELECTRICAL CONNECTOR WITH TERMINAL POSITIONING STRUCTURE

This application claims the benefits of the Taiwan Patent Application Serial NO. 097223332, filed on Dec. 26, 2008, the subject matter of which is incorporated herein by reference.

BACKGROUND OF THE INVENTION

1. Field of the Invention

The present invention relates to an electrical connector, more particularly to an electrical connector having a positioning member for securely positioning the terminals therein.

2. Description of the Prior Art

Most of PCs (personal computer), TV sets and electronic devices have an outer casing provided with built-in electrical connector so as to be connected electrically with a peripheral device (such as DVD player) to facilitate signal transmission therebetween. Due to rapid advance in the information technology, data transmission between the electronic device and the peripheral device becomes larger day by day, such as the high-definition multimedia interface has a video transmission rate of 8.16 Gbt/s. Therefore, the number of terminal in the electronic device increases relatively fast and the electromagnetic interference caused due to the terminal increment also rises consequently.

Since the number of terminal increases, it is relatively difficult to space the terminals from one another in a neat and smooth manner. In case of unable to maintain the terminals in a precise and orderly manner, the terminals may result in disqualified product after assembly. In addition, in order to lower the electromagnetic interference caused among the terminals, in some assembling methods, the middle sections of upper row of terminals are arranged to be staggered with the middle section of lower row of terminals. It is found that the preceding arrangement may affect uniformity and alignment of the distal section of the terminals. Moreover, the prior art method of bending portions of the terminals perpendicularly and then after mounting the same to an insulated member also decreases the data transmission ability of the electronic device.

SUMMARY OF THE INVENTION

Therefore, the object of the present invention is to provide an electrical connector having an insulated main body, a positioning member, and a plurality of terminals, wherein, the terminals have contact sections and inclined sections embedded within the insulated main body and the positioning member by means of an insert molding process such that the terminals are arranged in neat and uniform manner regardless of increased number, thereby precisely maintaining the proper positions of the terminals so as to avoid the problems encountered in the prior art electrical connector.

The electrical connector according to the present invention includes an insulated main body, a positioning member, a plurality of terminals and a shield shell.

The insulated main body includes a base portion and a tongue plate. The base portion has a front end face and a rear end face opposite to the front end face. The tongue plate projects frontward from the front end face of the base portion along an assembling direction.

Each terminal has a contact section embedded in the tongue plate via an insert-molding process and an inclined section extending from one end of the contact section along an oblique direction inclined with respect to the assembling direction, wherein the inclined section has at least one strip embedded within the positioning member via the insert-molding process.

The electrical connector of the present invention further includes a module casing enclosing the main body from above and a shield shell enclosing the module casing from above. Since the insert-molding process is used to embed the contact sections of the terminals within the tongue plate and the inclined sections thereof within the positioning member, the entire terminals are arranged in neat and uniform manner regardless of increased number, thereby precisely maintaining the proper positions of the terminals. The present electrical connector has a better data transmission ability when compared to the prior art electrical connector.

In one embodiment, the contact section and the inclined section of each of the terminals cooperatively define a blunt angle at an adjoining position thereof for maintaining the fine data transmission. The contact section and the inclined section of each terminal are bent to a desired angle according to the requirement of the design without causing the extra production expense. The bending of the contact and inclined sections of each terminal does not affect alignment and uniform spacing of the terminals.

Moreover, since the terminals, the positioning member and the insulated main body are assembled into one unitary piece, the assembling of the other parts, such as the shield shell, is quicken and easy, thereby saving a relatively large assembling time.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
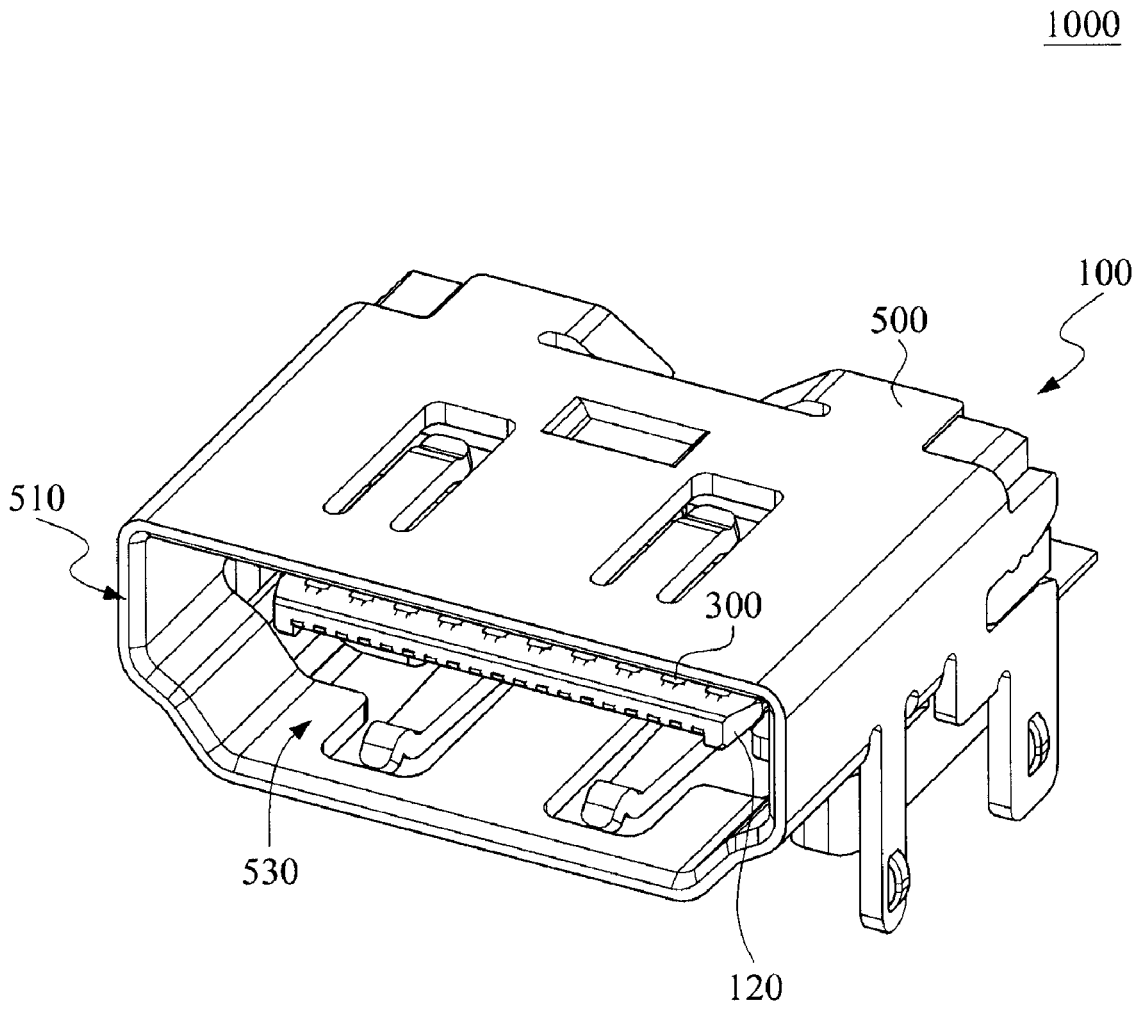
FIG. 1 is a perspective view of an electrical connector of the present invention.
Figure 2:
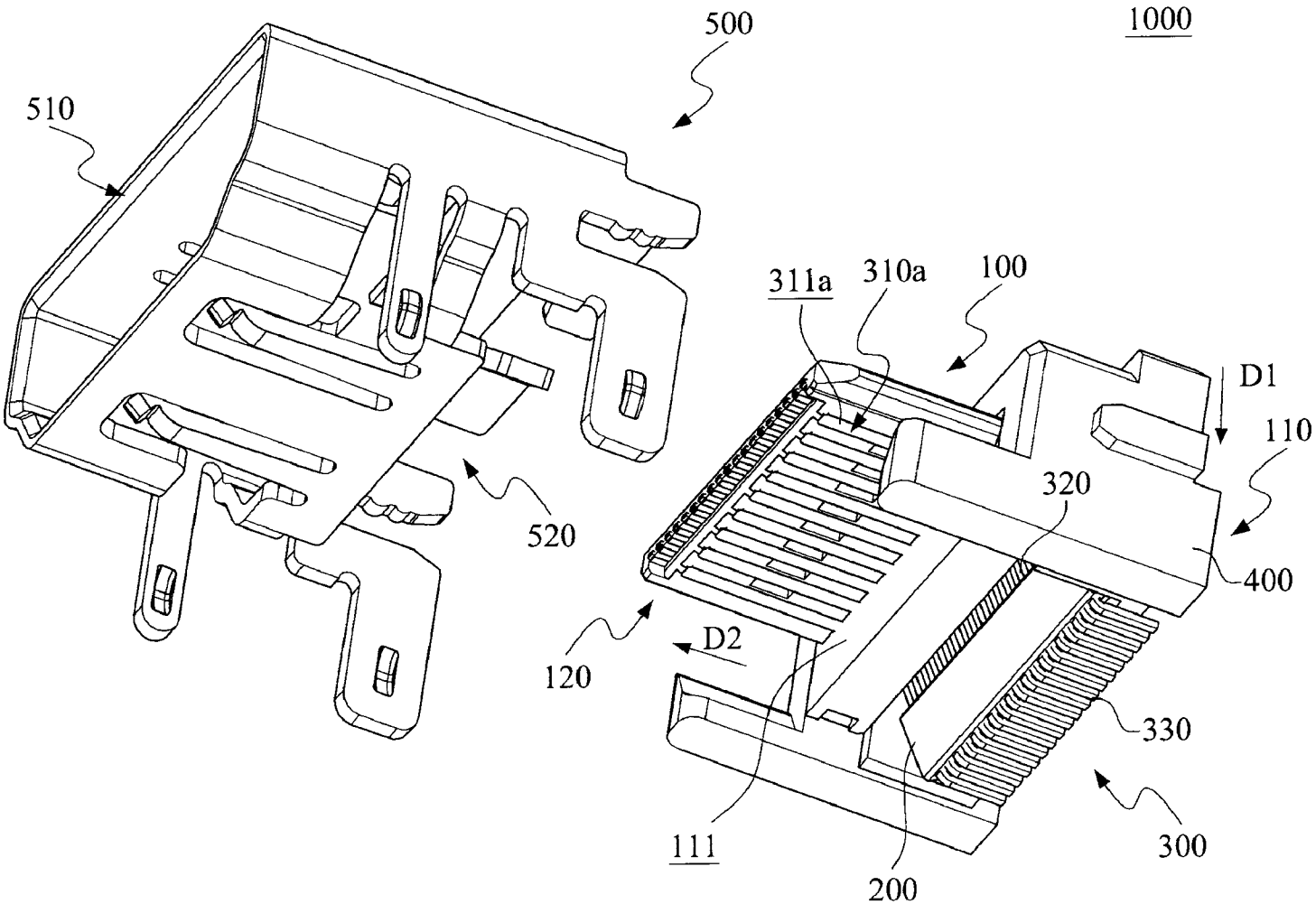
FIG. 2 is a partly exploded view of the electrical connector of the present invention.
Figure 3:
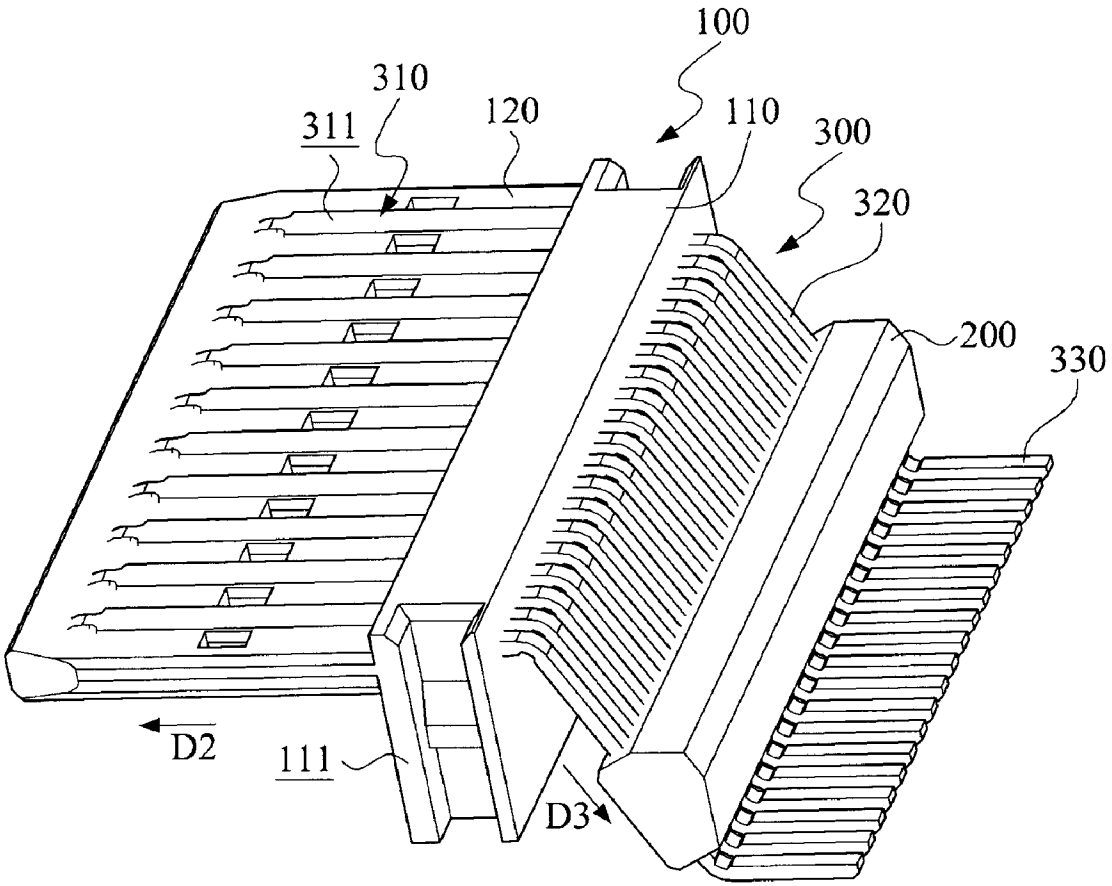
FIG. 3 is a perspective view of an insulated main body and a positioning member cooperatively holding a plurality of terminals in the electrical connector of the present invention.

Referring to FIGS. 1 to 3, wherein FIG. 1 is a perspective view of an electrical connector of the present invention, FIG. 2 is a schematic view of one embodiment of the electronic device of the present invention while FIG. 3 is a perspective view of an insulated main body and a positioning member cooperatively holding a plurality of terminals in the electrical connector of the present invention. The electrical connector 1000 accordingly includes an insulated main body 100, a positioning member 200, a terminal set consisting of a plurality of terminals 300, a module casing 400 and a shield shell 500.

The insulated main body 100 includes a base portion 110 having a front end face 111 and a rear end face 112 opposite to the front end face, and a tongue plate 120. The front and rear end faces extend along the D1 direction. The tongue plate

120 projects frontward from the front end face 111 of the base portion 110 along an assembling direction D2 generally transverse to the D1 direction.

Each terminal 300 has a contact section 310 embedded in the tongue plate 120 via an insert-molding process, an inclined section 320 and a mounting section 330. The contact 310 of each terminal 300 has a contact surface 311 exposed from one side of the tongue plate 120. In the present embodiment, the terminal set includes a plurality of first terminals and a plurality of second terminals, each being disposed between adjacent two of the first terminals. The contact surfaces 311 of the contact sections 310 in the first terminals are exposed from a bottom side of the tongue pate 120 while the contact surfaces 311*a* of the contact sections 310*a* in the second terminals are exposed from an upper side of the tongue plate 120. Note that the contact sections 310 of the first terminals in the upper row are staggered relative to the contact sections 310*a* of the second terminals in the lower row and are partially embedded in the tongue plate 120, thereby exposing the contact surfaces 311, 311*a* to an exterior thereof.

The inclined section 320 extends from one end of the contact section 310 along an oblique direction D3 inclined with respect to the assembling direction D2. The inclined section 320 has at least one strip embedded within the positioning member 200 via the insert-molding process.

The contact section 310 and the inclined section 320 of each of the terminals 300 cooperatively define a blunt angle at an adjoining position thereof. The blunt angle formed accordingly provides better data transmission ability when compared to the perpendicularly bent terminal of the prior art. Later, the contact section 310 and the inclined section 320 of each terminal are bent to a desired angle according to the requirement of the different standards and designs. In this embodiment, in order to complement with the rear end face 112 of the insulated main body 100, the contact section 310 is bent in a manner to touch the positioning member 200 appropriately. Forming of the preceding operation does not cause extra production expense. Moreover, the bending of the inclined section relative to the contact section does not affect of the uniform spacing and alignment among the terminals since terminal uniform spacing and alignment is maintained due to the insert-molding process.

Each of the terminals 300 further has a mounting section 330 extending from one end of the inclined section 320. The inclined section 320 and the mounting section 330 of each of the terminals 300 cooperatively define a blunt angle at an adjoining position thereof. The blunt angle formed accordingly provides better data transmission ability when compared to the perpendicularly bent terminal of the prior art.

The module casing 400 encloses the insulated main body 100 from above. The module casing 400 is made from dielectric materials and its design complements with that of the shield shell 500. The shield shell 500 encloses the module casing from above. The shield shell 500 is made by punching and simultaneously bending a metal plate. The shield shell 500 has a front open end 510 and a rear open end 520. Once the insulated main body 100 is inserted into the shield shell 500, a plug-reception chamber 530 is defined between the tongue plate 120 and the shield shell 500. A plug of an external electrical connector (not shown) can be inserted into the plug-reception chamber 530 of the present electrical connector 1000.

During the assembly, the terminals 300 are mounted to the positioning member 200 and the insulated main body 100 via the insert-molding process and later the tongue plate 120 is inserted along the assembling direction D2 into the shield shell 500 from the rear opening 520, thereby completing the assembly. It is relatively easy to conduct the assembling process and simultaneously shorten the assembling time.

As explained above, the contact sections 310 and the inclined sections 320 of the terminals 300 are respectively embedded within the tongue plate 120 and the positioning member 200 via the insert-molding process such that the terminals 300 become a part of the final product (the electrical connector 1000) and provides uniform spacing and alignment among the terminals regardless of the increased number. According to the prior art, the terminals may bend or lead to non-uniform due to collision against inner parts of the insulated main body during the insertion. Under such condition, it is difficult to precisely solder the terminals onto the printed circuit board and finally leading to discard of the half-finished electrical connector. The aforesaid assembling process of the terminals 300 to the insulated main body 100 results in fine production of the electrical connector of the present invention.

Figure 4:
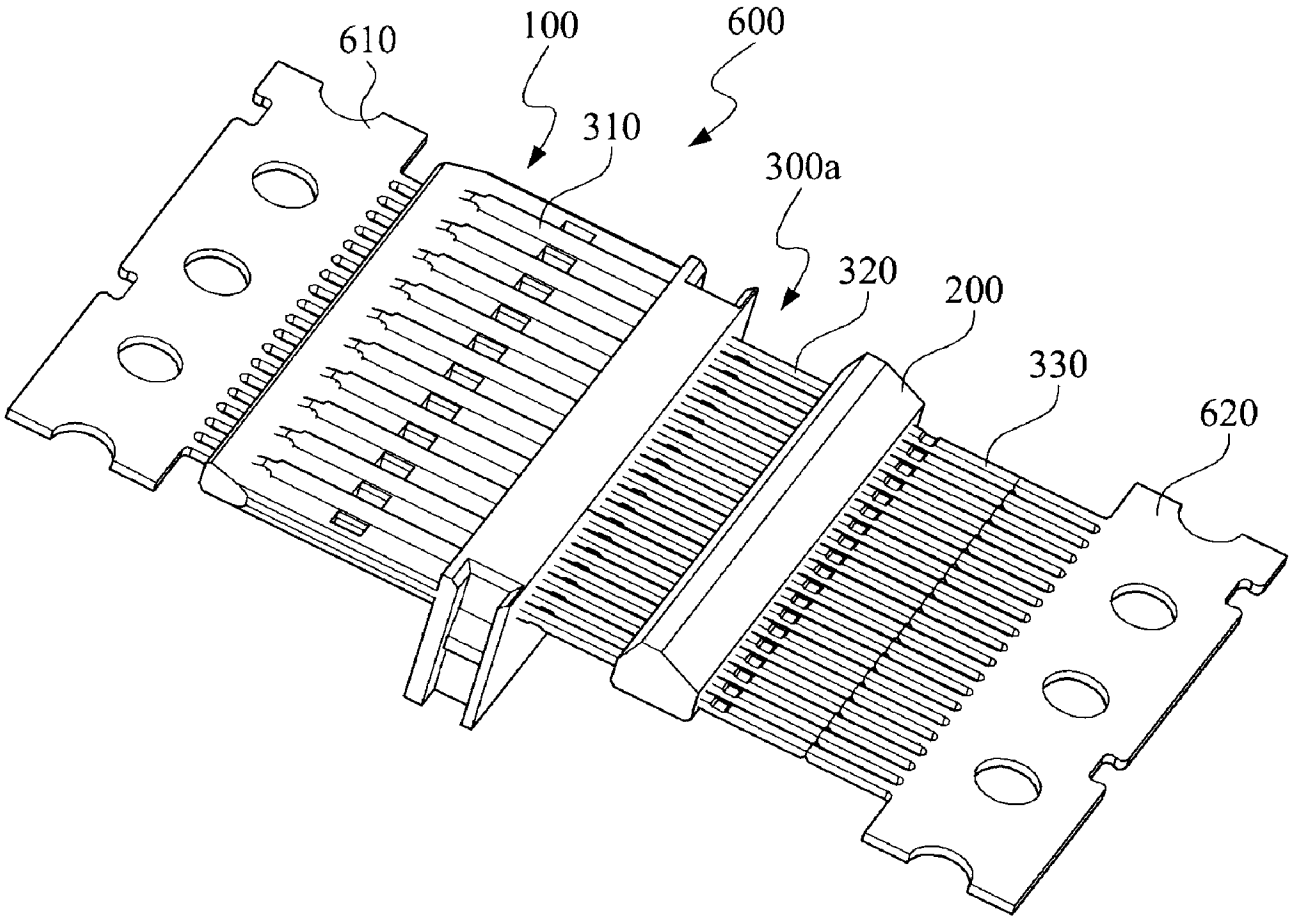
FIG. 4 is a perspective view illustrating the insulated main body and the positioning member cooperatively holding a metal plate for forming the terminals in the electrical connector of the present invention.

FIG. 4 is a perspective view illustrating the insulated main body 100 and the positioning member 200 cooperatively holding a metal plate 600 for forming the terminals 300*a* in the electrical connector of the present invention, wherein the terminals 300*a* are formed by punching and bending the metal plate 600. The metal plate 600 has a plurality of the terminals 300 and two distal end strips 610, 620. After the terminals 300 are embedded into the positioning member 200 and/or the insulated main body 100 via the insert-molding process, the inclined section 320 and the mounting section 330 are bent into the desired angle. Afterward, the distal end strips 610, 620 are machined or cut off to achieve the uniformity of the terminals 300.

Figure 5:
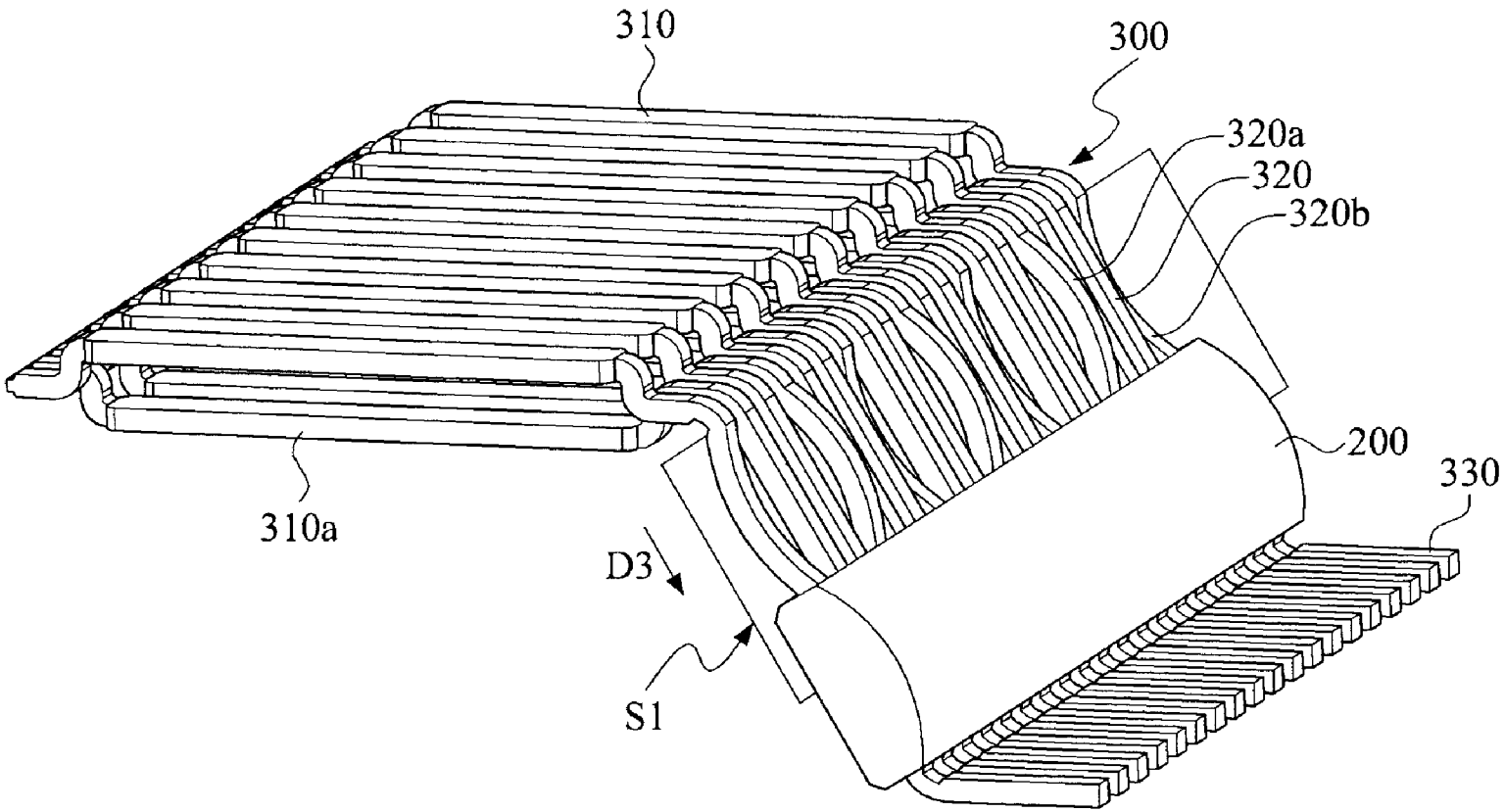
FIG. 5 shows a modified terminal set employed in the electrical connector of the present invention.

FIG. 5 shows a modified terminal set employed in the electrical connector of the present invention, wherein the terminals 300 include a plurality of first terminals and a plurality of second terminals, each being disposed between adjacent two of the first terminals. The inclined sections 320*b* of the second terminals cooperatively define a basic plane S1 along the oblique direction D3. The inclined section 320*a* of the first terminal projects upward from the basic plane S1. To be more specific, the inclined sections 320*b* of the second terminals are bent to a first predetermined side so as to define the basic plane S1. The inclined sections 320*a* of the first terminals are bent to a second predetermined side opposite to the first predetermined side so as to project upward from the basic plane S1.

Since the inclined section 320*a*, 320*b* are formed by punching and bending operation and thus are under stress such that the mounting sections 330 are disposed to be non-uniform. In order to avoid the non-uniform problem of the mounting sections 330, the inclined sections 320*a*, 320*b* of the terminals 300 are mounted firstly to the positioning member 200 via the insert-molding process. Hence the uniformity of the mounting sections 330 of the terminals 300 is achieved.

While the invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An electrical connector comprising:

a positioning member;

an insulated main body including a base portion having a front end face and a rear end face opposite to said front end face, and a tongue plate projecting frontward from said front end face of said base portion along an assembling direction; and a plurality of terminals, each having a contact section, a mounting section, and an intermediate section extending therebetween, said contact section being embedded in said tongue plate, said intermediate section extending from said insulated main body substantially along an oblique direction inclined with respect to said assembling direction, wherein said intermediate section of at least one said terminal extends to be partially embedded within said positioning member, said positioning member being offset from said insulated main body along the oblique direction;

wherein a portion of said terminals include intermediate sections defining a bulbous contour, said intermediate sections of a first portion of a second terminal of said terminals are bent to bulbously protrude toward a first predetermined side, said intermediate sections of a second portion of a first terminal of said terminals being bent to protrude toward a second predetermined side opposite to said first predetermined side.

2. The electrical connector according to claim 1, wherein said contact section of each of said terminals has a contact surface exposed from said tongue plate.

3. The electrical connector according to claim 1, wherein said contact section and said intermediate section of each of said terminals cooperatively define a blunt angle at an adjoining position thereof.

4. The electrical connector according to claim 1, further comprising a module casing forming a covering above said main body and a shield shell forming a covering above said module casing.

5. The electrical connector according to claim 1, wherein each of said terminals further has said mounting section extending from one end of said intermediate section and emerging out of said positioning member.

6. The electrical connector according to claim 5, wherein said intermediate section and said mounting section of each of said terminals cooperatively define a blunt angle at an adjoining position thereof.

* * * * *